US005774051A

United States Patent [19]

Kostusiak

[11] Patent Number: 5,774,051

[45] Date of Patent: Jun. 30, 1998

[54] SECURITY SYSTEM WITH MULTI-FUNCTION TRANSMITTER

[75] Inventor: Karl Henry Kostusiak, Pittsford, N.Y.

[73] Assignee: Detection Systems, Inc., Fairport, N.Y.

[21] Appl. No.: 562,975

[22] Filed: Nov. 27, 1995

[51] Int. Cl.[6] ..... G08B 1/08

[52] U.S. Cl. ..... 340/539; 341/176; 341/825.69

[58] Field of Search ..... 340/539, 425.5, 340/426, 825.69, 825.72; 341/176; 455/91, 95

[56] References Cited

U.S. PATENT DOCUMENTS

| | | | |
|---|---|---|---|
| 3,833,895 | 9/1974 | Fecteau | 340/224 |
| 4,611,198 | 9/1986 | Levinson et al. | 340/539 |
| 4,694,282 | 9/1987 | Tamura et al. | 340/539 |
| 4,754,255 | 6/1988 | Sanders et al. | 340/825.69 |
| 4,884,060 | 11/1989 | Shapiro | 340/514 |
| 5,113,182 | 5/1992 | Suman et al. | 340/825.31 |
| 5,252,966 | 10/1993 | Lambropoulos et al. | 340/825.69 |
| 5,365,217 | 11/1994 | Toner | 340/539 |
| 5,416,466 | 5/1995 | Malvaso et al. | 340/539 |

*Primary Examiner*—Donnie L. Crosland
*Attorney, Agent, or Firm*—J. Addison Mathews

[57] ABSTRACT

A security system including a hand-portable wireless communicator having two keys for selecting and executing signal transmissions that control the system. The function of each key is determined by the order in which the keys are actuated, so the first actuated key selects the mode of operation and the other key executes the transmission. Sequential actuation of the keys, first one and then the other, initiates a test. Simultaneous actuation of the keys initiates an alarm. Multiple actuation of the same key cycles through alternative modes of operation, like armed, partially armed or disarmed. Transmission of a signal representing the selected mode is then initiated by actuation of the other key. A reset mechanism reinitiates the key functions after a predetermined time interval, so the key function is determined based on an order of actuation after said reinitiation.

22 Claims, 4 Drawing Sheets

SECURITY SYSTEM WITH MULTI-FUNCTION TRANSMITTER

DESCRIPTION

1. Field of Invention

The invention relates to security systems for intrusion and fire detection, personal safety and the like. More specifically, the invention relates to such systems including one or more hand holdable transmitters for controlling the system with a wireless signal.

2. Background of the Invention

Security systems typically have several modes of operation controlled from a keypad on the secured premises. A personal identification number is entered to validate authorized users, who can then select the desired mode of operation. The system can be partially or fully armed or disarmed from the keypad, or a test sequence might be initiated. A panic mode also is available for activating the alarm in case there is an undetected event first recognized by the user.

In addition to keypads, portable transmitters have been employed for selecting the operating mode from remote locations. One is disclosed in Fecteau U.S. Pat. No. 3,833,895, including a radio frequency transmitter having two buttons. Depression of one button interrogates the system and initiates a delay mode permitting authorized entry of the monitored premises without activating the alarm. Simultaneous depression of both buttons activates the system alarm to summon help in a personal emergency. Another example is disclosed in Tamura et al U.S. Pat. No. 4,694,282. The Tamura transmitter includes several buttons for controlling a security system and a separate panic button for personal emergencies. Still another example is presented by Shapiro in U.S. Pat. No. 4,884,060. He discloses a subscriber unit having a multi-function switch for selecting between home or away modes of operation. In the home mode, activation of a portable transmitter sends an emergency signal to call for help. In the away mode, the same portable transmitter is used for command and control purposes.

Although hardwired keypads provide many advantages, they are limited by their fixed locations, which must be approached by the user to operate the system. Typical locations are inside the protected area, requiring an alarm delay to permit disarming at the keypad for authorized entry. Portable transmitters solve many such problems, but are cumbersome to operate, have too many keys or only limited functions. Many are undesirably large or heavy and do not provide important features. Examples include confirmation of a valid communication, or a panic function that is easy to operate intentionally but not accidentally. The transmitter should be available whenever the user leaves the premises, and its operation should be intuitive, so the user is not required to remember detailed sequences after periods of inactivity.

SUMMARY OF THE INVENTION

The present invention is directed to overcoming one or more of the problems set forth above. Briefly summarized, according to one aspect of the invention, a hand-portable wireless communicator includes two keys for selecting and causing signal transmissions that control a security system. The function of each key is determined by the order in which the keys are actuated, so the first actuated key selects the mode of operation and the other key initiates the transmission. Sequential actuation of alternate keys, first one and then the other, initiates a test. Simultaneous actuation of both keys initiates an alarm. Multiple actuation of the same key cycles through alternative modes of operation, including armed, partially armed or disarmed. Transmission of a signal representing the selected mode is then executed by actuation of the other key. A reset mechanism reinitiates the key functions after a predetermined time interval, so the key function is determined based on an order of actuation after said reinitiation.

According to more specific features, visible and audible indicators are provided for uniquely representing each of the alternative operating modes when it is selected. The transmitter also may be combined with a small receiver for detecting confirmation signals from the system, and the indicators then provide a corresponding signal representing successful implementation of the transmitted signal. A unique identification number associated with each transmitter permits authentication of the user and retrieval of information about the user.

Still more specifically, the invention relates to an intrusion detection system having a plurality of operating modes, such as armed and disarmed. The system includes a receiver for detecting radio frequency signals and a control responsive to the received signals for setting the system in an alternative one of the operating modes. The system further includes a portable transmitter for sending the signals to the receiver. The transmitter has two actuation elements for: a) selecting a desired system operating mode and b) initiating transmission of a radio frequency signal representing the selected mode. The selection and transmission functions are assigned to the respective actuation elements based on an actuation order, assigning a selection function to the first actuated one of the elements and a transmission function to the other one of the elements.

The invention provides a very small transmitter capable of transmitting numerous alternative control signals with only two actuation keys. Operation is intuitive, and includes testing and panic alarm operations as well as arming and disarming of the system. The transmitter preferably is combined with a key ring so it will be available under most instances when the user enters or exits the protected premises.

These and other features and advantages of the invention will be more clearly understood and appreciated from a review of the following detailed description of the preferred embodiments and appended claims, and by reference to the accompanying drawings.

DETAILED DESCRIPTION OF THE INVENTION

Figure 1:
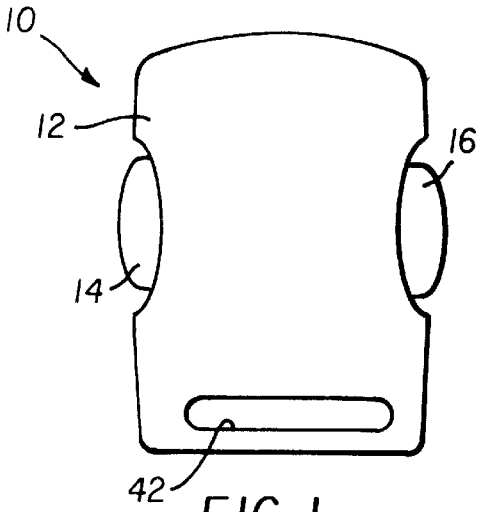
FIGS. 1 and 2 are front and back views, respectively, of a hand portable communicator including a two button transmitter for use with a security system in accordance a preferred embodiment of the invention.
Figure 2:
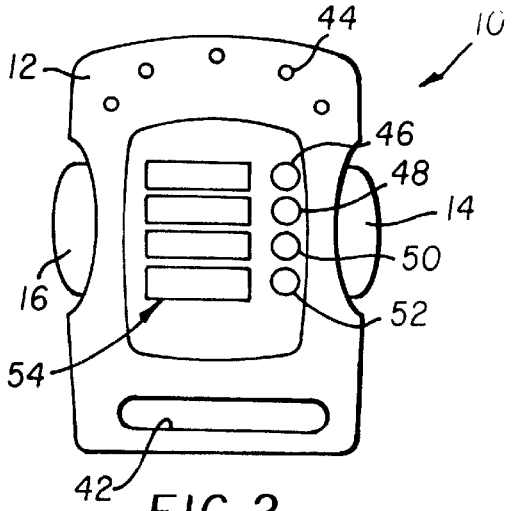
Figure 3:
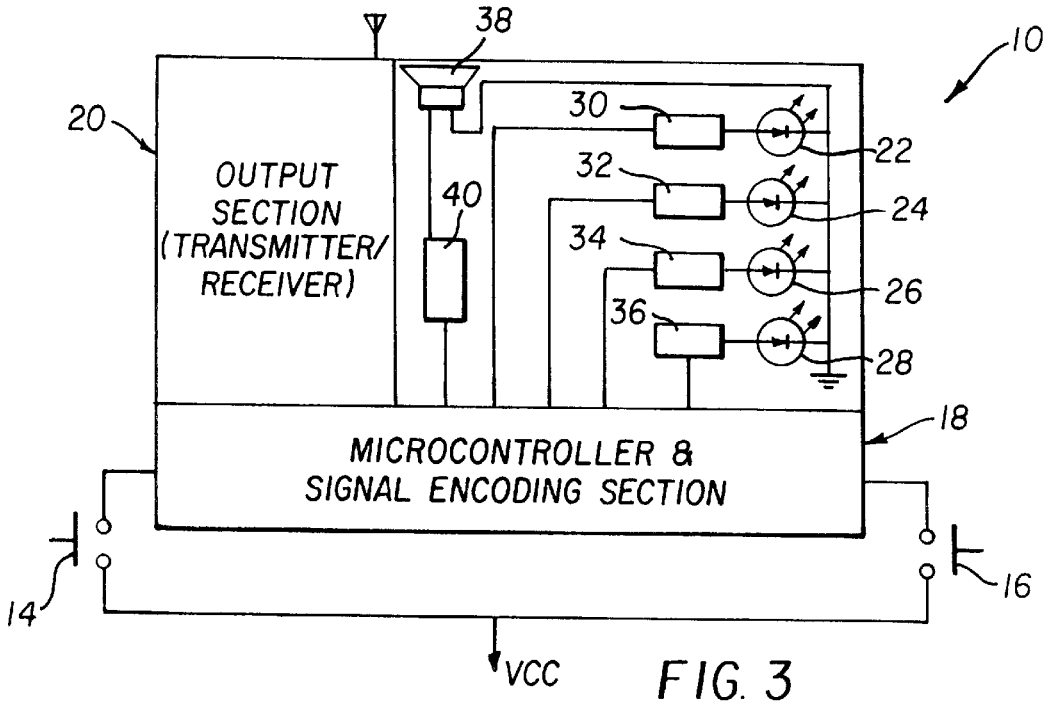
FIG. 3 is a schematic view of the communicator of FIGS. 1 and 2 illustrating selected features in more detail.
Figure 4:
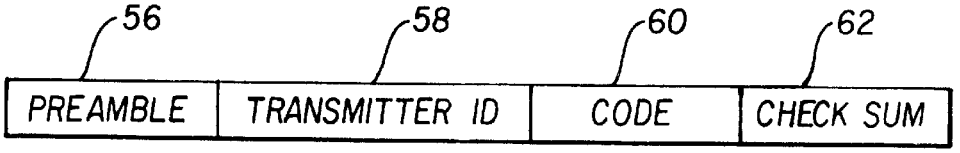
FIG. 4 is a schematic view of a signal transmitted by the communicator of FIGS. 1 and 2.

Referring now to the drawings, and beginning with FIGS. 1–4, a preferred embodiment of the invention is depicted in a hand holdable and portable communicator 10. The communicator is adapted for sending wireless control signals to a security system to set its operating mode, typically including "test," "disarmed" and partially and fully armed modes for "home" and "away," respectively. Features of a preferred security system will be described more fully hereinafter in connection with FIG. 7.

The communicator has particular utility when used with several different types of security systems, such as: a personal security system on a college campus, which calls for help in a personal emergency; an intruder and fire detection system in a home or business; and a car-located security system which might include theft prevention and vehicle location. The communicator also might be combined with an automobile controller for locking and unlocking doors, starting the engine or sounding the horn. This description is directed primarily to a fire and intrusion detection system, but easily can be modified for combined applications.

The communicator includes a casing 12 supporting two actuation elements depicted as operating keys 14 and 16 and containing a microcontroller and signal encoding section 18 and an output section 20, including a transmitter and receiver, sometimes referred to as a transceiver. A plurality of visible indicators, such as light emitting diodes 22, 24, 26 and 28, are connected to the microcontroller through appropriate drivers 30, 32, 34 and 36, and a piezoelectric horn 38 is coupled in a similar manner through driver 40.

The casing itself is adapted as a key ring, and for that purpose includes an elongated aperture 42 for receiving a key chain. The casing also defines an array of protrusions 44 which permit orientation of the casing by tactile senses without requiring its removal from a pocket or purse. It will become apparent, however, from the following description, that the communicator can be operated in almost any orientation with the same results.

The casing also includes a transparent panel, or apertures 46, 48, 50 and 52, for viewing the light emitting diodes, and appropriate surfaces 54 including identifying markings corresponding to the above-noted operating modes: test, disarmed, away and home.

The communicator is operated by actuation of keys 14 and 16 to select and transmit a coded radio frequency signal that is detected by the security system, which then acts to set the system in the desired mode. The transmitted signal is depicted schematically in FIG. 4, including a preamble 56, a identification code 58 unique to the transmitter, a code 60 representing the desired system operating mode and a check sum 62 for detecting errors. It is the code 58, preferably a multi-bit string, that represents the available operating modes, typically including "test," "disarm," "away" and "home," as mentioned above.

The present invention is directed more specifically to a communicator of the type described above in which selection and execution functions are assigned to the keys 14 and 16 in accordance with the order in which the keys are activated. The first activated key becomes the selection key, and continued actuation of that same key cycles the selected mode through the available options, e.g. test, disarm, away and home. The other key then becomes the execution key, causing transmission of the signal including a code representing the selected option. Alternate actuation of the keys, first one and then the other, transmits a signal including a test code. Simultaneous activation of both keys transmits a signal including an alarm code. Actuation of only one key will not initiate any transmission, which is one approach used for reducing false alarms. After a predetermined time period, such as ten seconds, the communicator resets. The sequential order of actuation is then determined in accordance with the order implemented after the reset.

Figure 5:
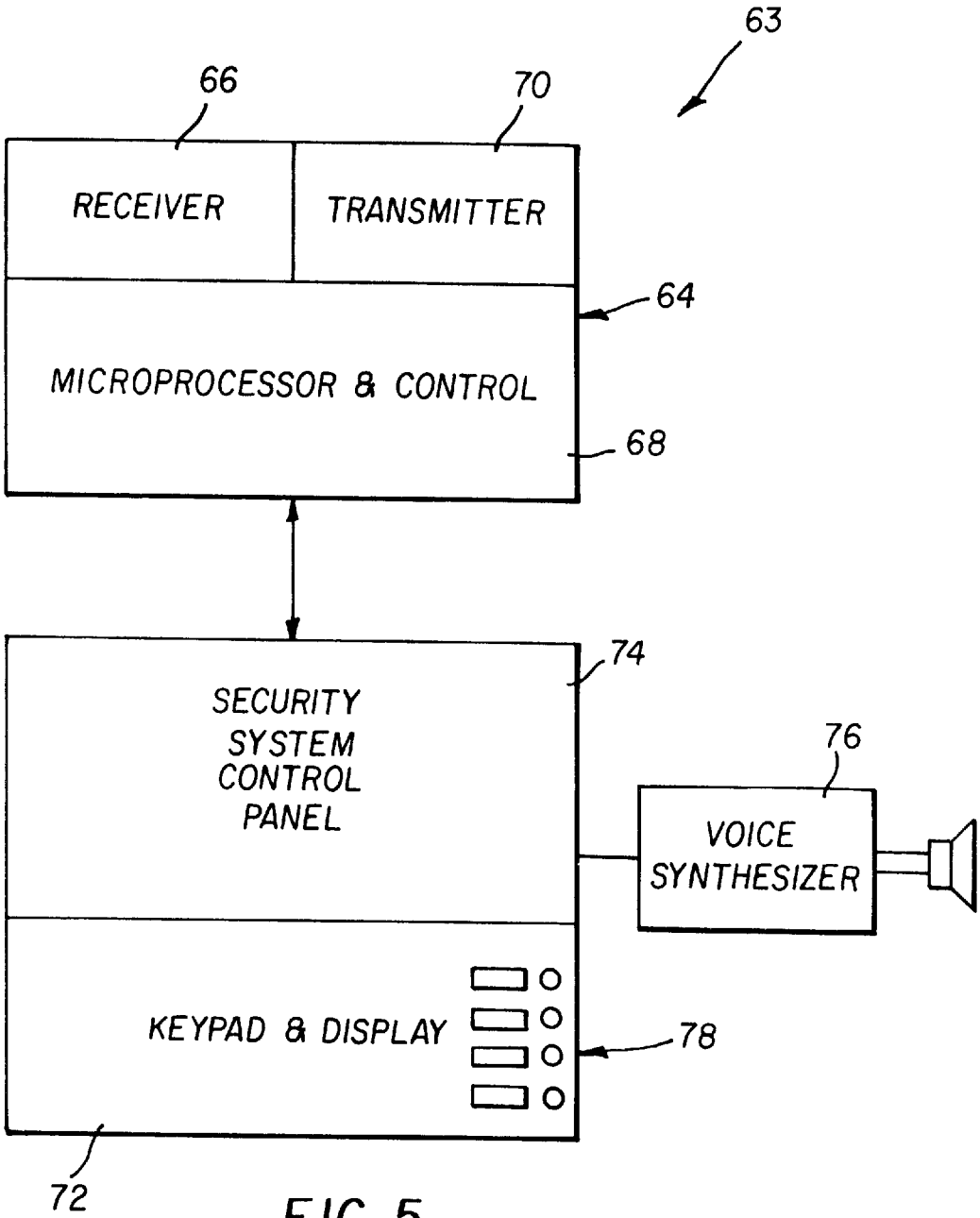
FIG. 5 is a block diagram representing a security system including a control panel and interface card according to the preferred embodiment.

Referring now to FIG. 5, a fire and intruder detection system 63 is disclosed with a radio frequency interface card 64 controlled by signals from communicator 10. The interface card 64 has a receiver 66, a microprocessor and control 68 and a fixed transmitter 70. Signals transmitted by the portable communicator 10 are detected by receiver 66 and used by the microprocessor and control to determine the desired mode of operation of the detection system. The interface card 64 then emulates a standard keypad 72, acting through the control panel 74, to control the detection system, setting the system to the mode selected and transmitted by the communicator 10. A voice synthesizer 76 and local light emitting diodes 78 also may be provided to indicate the mode of operation.

Assuming a successful communication and mode change, microprocessor 68 directs the fixed transmitter 70 to issue a radio frequency confirmation signal. The confirmation signal is detected by transceiver 20 (FIG. 3), and one or more of the light emitting diodes, e.g. 22, and/or the piezoelectric horn 38, emits a perceptible indication of the confirmation. In this preferred embodiment, the light emitting diode associated with the selected and transmitted mode signal, blinks a number of times to indicate receipt of the confirmation signal.

Figure 6:
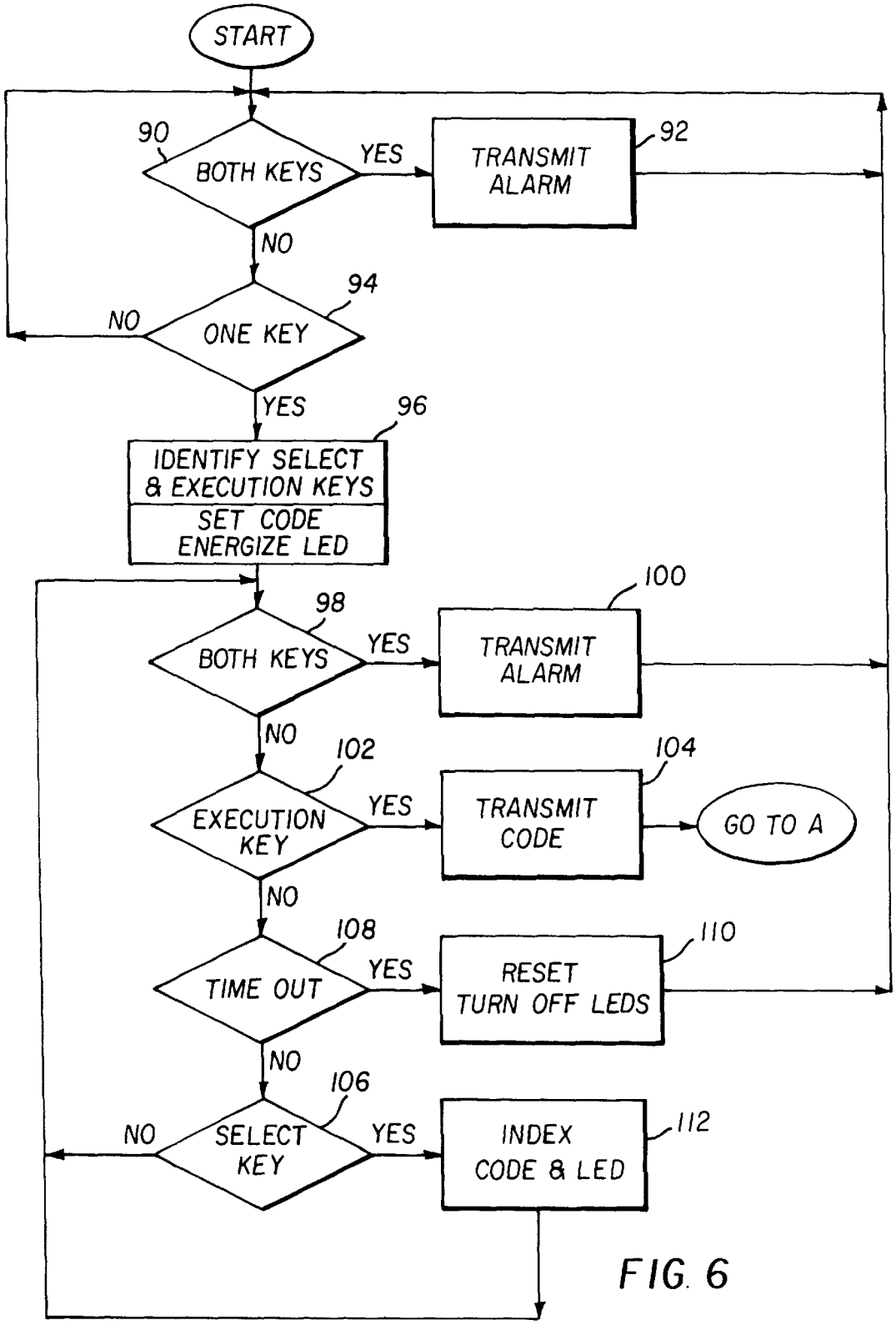
FIGS. 6 and 7 are flow diagrams of a process carried out by the communicator of FIGS. 1 and 2 according to the preferred embodiment.
Figure 7:
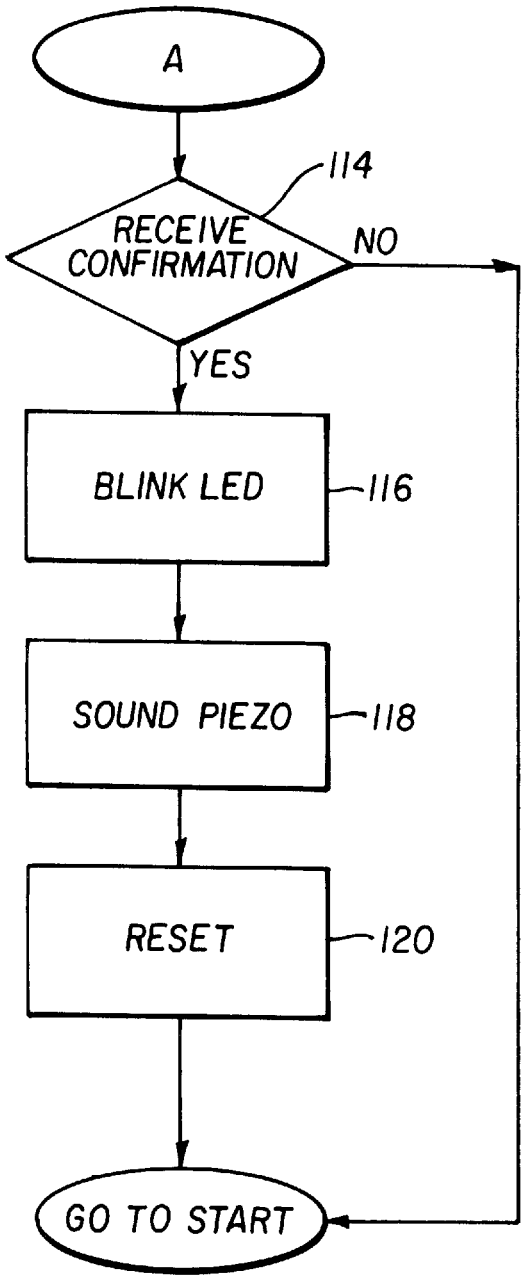

Referring now to FIGS. 6 and 7, flow diagrams are presented depicting the operation of the transmitter 10 with the security system of FIG. 5. If both keys are depressed simultaneously, box 90, an alarm signal is transmitted, box 92. If only one key is depressed, box 94, that key becomes the selection key and the other key becomes the execution key, box 96. The function code is set for the test mode, and the corresponding light emitting diode is energized to show the test mode is selected, box 96. The piezoelectric horn also is sounded, as it is whenever any key is depressed. For the purpose of simplicity, however, this is not represented on the flow diagrams.

If both keys are depressed simultaneously, box 98, the alarm signal is transmitted, box 100. If the other key is depressed, box 102, the selected code is transmitted, box 104. If the same key is depressed again, box 106, the microprocessor indexes through the available codes until one is selected or a time out period is exceeded, box 108, resetting the sequence, box 110. Again, the selected code is indicated by a corresponding light emitting diode, box 112.

When the execution key is depressed, a representation of the selected code is transmitted to the security system interface card 64 (FIG. 5). The interface card emulates a keypad, sets the security system to the operating mode corresponding to the selected and transmitted code, and returns a confirmation signal to the portable communicator, box 114 (FIG. 7). The communicator then blinks one of the light emitting diodes, box 116 and sounds the piezoelectric horn, box 118. The microcontroller then resets the process for the next operation, box 120.

It should now be apparent that an improved communicator is provided for use with security systems, including fire and intruder detection systems, personal security systems and car security systems. The communicator includes two keys that initiate transmission of an alarm signal when depressed simultaneously. Alternate depression of the keys, first one and then the other, selects and transmits a test signal. The first depression of either key also selects the function of that key, making it a selection key. The other key then becomes the execution key. Repeated depression of the selection key cycles between respective codes representing the operational modes of the security system. Depression of the execution key initiates transmission of a radio frequency signal including a representation of the selected code, thereby setting the operational mode of the security system.

While the invention is described in connection with a preferred embodiment, other modifications and applications will occur to those skilled in the art. The claims should be interpreted to fairly cover all such modifications and applications within the true spirit and scope of the invention.

PARTS LIST

| Reference No. | Part |
|---|---|
| 10. | Communicator |
| 12. | Casing |
| 14. | Operating key |
| 16. | Operating key |
| 18. | Microcontroller and signal encoding section |
| 20. | Output section |
| 22. | Light emitting diode |
| 24. | Light emitting diode |
| 26. | Light emitting diode |
| 28. | Light emitting diode |
| 30. | Driver |
| 32. | Driver |
| 34. | Driver |
| 36. | Driver |
| 38. | Piezoelectric horn |
| 40. | Driver |
| 42. | Elongated aperture |
| 44. | Protrusions |
| 46. | Apertures |
| 48. | Apertures |
| 50. | Apertures |
| 52. | Apertures |
| 54. | Marking surfaces |
| 56. | Signal preamble |
| 58. | Transmitter identification code |
| 60. | Mode code |
| 62. | Check sum error detection |
| 63. | Fire and intruder detection system |
| 64. | Interface card |
| 66. | Receiver |
| 68. | Microprocessor and control |
| 70. | Fixed transmitter |
| 72. | Keypad |
| 74. | Control panel |
| 76. | Voice synthesizer |
| 78. | Light emitting diodes |
| 90–118 (even Nos.) | flow diagram boxes. |

I claim:

1. A hand portable communicator for controlling a security system having alternative modes of operation, said communicator including a wireless transmitter and two keys actuatable to operate said transmitter and control said system; said communicator comprising:

means for assigning functions to said respective keys based on an order in which said keys are actuated, said means: a) assigning to a first actuated one of said keys a mode selecting function selecting between said alternative operating modes; and, b) assigning to the other one of said keys a transmission execution function transmitting said selection of said first actuated one of said keys.

2. The invention of claim 1, wherein said communicator includes a signal encoding section and repeated actuation of said first actuated key, before actuation of said other one of said keys, cycles said section through a series of codes to select a respective one of said codes, and actuation of said other one of said keys causes said transmitter to transmit a signal including a representation/ of said selected code.

3. The invention of claim 2, wherein simultaneous actuation of said keys operates said transmitter to transmit an alarm signal.

4. The invention of claim 2, wherein a single actuation of one of said keys followed by actuation of the other of said keys operates said transmitter to transmit a test signal, and simultaneous actuation of said two keys operates said transmitter to transmit an alarm signal different from said test signal.

5. The invention of claim 4, wherein said communicator includes a plurality of perceptible indicators and said assigning means selects between said indicators to provide a signal uniquely corresponding to each of said respective operating modes.

6. The invention of claim 2 wherein actuation of said first actuated key selects between a plurality of function bits respectively representing modes of operation of said security system, and actuation of said other one of said keys causes said transmitter to send a wireless signal including a representation of said selected function bit.

7. The invention of claim 1 including a receiver for receiving confirmation signals from said security system.

8. The invention of claim 6, wherein said communicator includes means for providing a signal uniquely corresponding to receipt of a confirmation signal from said security system.

9. The invention of claim 1, further including a reset mechanism for resetting said assignment means after a predetermined time interval, whereby said modes of operation are assigned to said respective keys based on an order of actuation after said resetting. section to select said system control code and the other one of said elements operating said output section to transmit said signal including said selected code.

10. A hand holdable transmitter having two actuation elements for operating said transmitter to control a security system; said transmitter comprising:

an encoding section selecting a system control code for controlling said security system;

an output section for transmitting a wireless signal including said selected system control code; and, means for assigning functions to said respective actuation elements based on an actuation order, said means assigning a first actuated one of said elements to operate said encoding section to select said system control code and assigning the other one of said elements to operate said output section to transmit said signal including said selected code.

11. The invention of claim 10, wherein simultaneous actuation of said two elements selects a system control code representing an alarm and operates said transmitter to transmit said alarm code.

12. The invention of claim 10, wherein a single actuation of one of said elements followed by actuation of the other of said elements selects and transmits a system test code, and simultaneous actuation of said two elements selects and transmits a system alarm code different from said test code.

13. The invention of claim 10, wherein repeated actuation of said first actuated element, before actuation of said other one of said elements, cycles said encoding section to select one respective code after another from said plurality of codes.

14. The invention of claim 13, wherein said transmitter includes a plurality of perceptible indicators and said encoding section further selects between said indicators to provide a unique signal for each respective code selected by said encoding section.

15. The invention of claim 10 including a receiver for receiving confirmation signals from said security system.

16. The invention of claim 15, wherein said transmitter includes means for providing a signal uniquely corresponding to receipt of a confirmation signal from said security system.

17. The invention of claim 10, further including a reset mechanism for resetting said encoding section after a predetermined time interval, whereby said function is assigned to said elements based on the order of actuation of said elements after said resetting.

18. The invention of claim 15, wherein said alarm signal includes an identification code unique to said respective transmitter.

19. The invention of claim 15 wherein said system is adapted to operate with a plurality of said portable transmitters, each of said portable transmitters includes means for transmitting a unique identification code with said alarm signal, and said interface includes means for discriminating between said portable transmitters based on said unique code.

20. An intrusion detection system having a plurality of operating modes including armed, and disarmed; said system comprising:

a radio frequency interface including a receiver for detecting radio frequency signals and a control responsive to receipt of said signals for setting the system in an alternative one of said operating modes;

a portable transmitter for sending said signals to said receiver, said transmitter having two actuation elements for operating said transmitter a) to select said alternative operating mode and b) to initiate transmission of a radio frequency signal representing said selected mode; and, means on said portable transmitter for assigning a) a mode selecting function to a first actuated one of said elements and b) a transmission initiating function to the other one of said elements.

21. The invention of claim 20, wherein said interface further includes a fixed transmitter for sending a confirmation signal to said portable transmitter and said portable transmitter includes a receiver for detecting said confirmation signal.

22. The invention of claim 20, wherein said system further includes a panic mode, simultaneous actuation of said elements transmits an alarm signal, and said interface sets said system in said panic mode in response to said alarm signal.

* * * * *